US007760098B2

(12) United States Patent
Sato

(10) Patent No.: US 7,760,098 B2
(45) Date of Patent: Jul. 20, 2010

(54) PORTABLE TERMINAL

(75) Inventor: Hiroki Sato, Kanagawa (JP)

(73) Assignee: Panasonic Corporation, Osaka (JP)

( * ) Notice: Subject to any disclaimer, the term of this patent is extended or adjusted under 35 U.S.C. 154(b) by 525 days.

(21) Appl. No.: 11/719,482

(22) PCT Filed: Nov. 17, 2005

(86) PCT No.: PCT/JP2005/021090

§ 371 (c)(1),
(2), (4) Date: May 16, 2007

(87) PCT Pub. No.: WO2006/059487

PCT Pub. Date: Jun. 8, 2006

(65) Prior Publication Data

US 2009/0224882 A1 Sep. 10, 2009

(30) Foreign Application Priority Data

Nov. 30, 2004 (JP) ..... 2004-346430

(51) Int. Cl.
*G08B 13/14* (2006.01)

(52) U.S. Cl. ..... 340/572.7; 235/451; 455/550.1

(58) Field of Classification Search ..... 340/572.7; 455/550.1; 235/451
See application file for complete search history.

(56) References Cited

U.S. PATENT DOCUMENTS

| | | | | |
|---|---|---|---|---|
| 7,261,240 | B2 * | 8/2007 | Akiho et al. | 235/492 |
| 7,420,367 | B2 * | 9/2008 | Bespalov et al. | 324/303 |
| 2005/0178835 | A1 * | 8/2005 | Akiho et al. | 235/451 |
| 2006/0061512 | A1 * | 3/2006 | Asano et al. | 343/702 |
| 2006/0103389 | A1 * | 5/2006 | Bespalov et al. | 324/338 |
| 2006/0284773 | A1 * | 12/2006 | Park et al. | 343/702 |
| 2009/0224882 | A1 * | 9/2009 | Sato | 340/10.1 |

(Continued)

FOREIGN PATENT DOCUMENTS

JP 3-280625 A 12/1991

(Continued)

OTHER PUBLICATIONS

International Search Report, dated Dec. 6, 2005.

*Primary Examiner*—Daniel Wu
*Assistant Examiner*—Bradley E Thompson
(74) *Attorney, Agent, or Firm*—Pearne & Gordon LLP

(57) ABSTRACT

The prevent invention provides a portable terminal capable of performing good contactless communication with a reader/writer antenna without generating a dead band even at the time of rear surface communication.

The portable terminal comprises: a lower case (2); an upper case (4); an electronic component mounting board (7) provided in the lower case (2) and having a first surface (5) and a second surface (6); an electronic component mounting board (14) provided in the upper case (4) and having a first surface (12) and a second surface (13), the first surface (12) being in opposition to the second surface (6) under the state the lower case (2) and the upper case (4) are in proximity to each other; a contactless communication antenna (8) provided in the lower case (2) oppositely to the first surface (5) of the electronic component mounting board (7) and performing the contactless communication with the reader/writer antenna; and a loop coil (15) provided in opposition to the second surface (13) of the electronic component mounting board (14).

7 Claims, 10 Drawing Sheets

U.S. PATENT DOCUMENTS

2009/0262028 A1 * 10/2009 Mumbru et al. ..... 343/702

FOREIGN PATENT DOCUMENTS

| | | | | |
|---|---|---|---|---|
| JP | 4-85836 | | | 7/1992 |
| JP | 5-75320 | A | | 3/1993 |
| JP | 5-501333 | | | 3/1993 |
| JP | 8-56109 | A2 | | 2/1996 |
| JP | 10-84406 | A | | 3/1998 |
| JP | 11-177485 | A | | 7/1999 |
| JP | 2002-171190 | A | | 6/2002 |
| JP | 2002-217800 | A | | 8/2002 |
| JP | 2003-152430 | A | | 5/2003 |
| JP | 2003-283225 | A2 | | 10/2003 |
| JP | 2004/153463 | A | * | 5/2004 |
| JP | 2004-153463 | A | | 5/2004 |
| JP | 2004/328610 | A | * | 11/2004 |
| JP | 2004-328610 | A | | 11/2004 |
| WO | 91/05373 | | | 4/1991 |

* cited by examiner

PORTABLE TERMINAL

TECHNICAL FIELD

The present invention relates to a portable terminal having a feature of a contactless IC card.

BACKGROUND ART

The conventional portable terminal of this type is shown in FIG. 10 as comprising a case 41 having an electronics device 40 built therein, a sheet-shaped flexible substrate 43 attached to an inner surface of the case 41 and having a contactless communication antenna for performing contactless communication with an outside reader/writer antenna 42, and a sheet-shaped soft magnetic radio wave absorbent 44 attached on the flexible substrate 43 to cover a contactless communication antenna therewith. The case 41 has an outer surface 45 being in back-to-back relationship with the inner surface having the contactless communication antenna attached thereon. The conventional portable terminal is designed to perform contactless communication under the state that the outer surface 45 and the reader/writer antenna 42 are approached to each other. This contactless communication is hereinafter referred to as "front surface communication". The conventional portable terminal thus constructed prevents a magnetic field produced by the reader/writer antenna 42 or the inside contactless communication antenna from being converted by a metal member or a shield case into an eddy current, and improves a performance of the front surface communication (see, for example, Patent Document 1).

Patent Document 1: Japanese Patent Laid-Open Publication 2004-153463 (page 4 and FIG. 1)

DISCLOSURE OF INVENTION

Problem to be Solved by the Invention

In the conventional portable terminal, the case 41 has an outer surface 46 being in back-to-back relationship with the outer surface 45 approached to the reader/writer antenna 42 at the time of the front surface communication. The conventional portable terminal is designed to perform the contactless communication under the state that the outer surface 46 and the reader/writer antenna 42 are approached to each other. This contactless communication is hereinafter referred to as "rear surface communication". The conventional portable terminal can improve the performance of the front surface communication; however, the conventional portable terminal has metal portions included in the electronics device 40, the case 41, and the like. The metal portions are liable to couple magnetically to the reader/writer antenna 42 at the time of the rear surface communication. This condition causes the decrement in an inductance of the reader/writer antenna 42. As a result, a resonance frequency of the reader/writer antenna 42 is changed beyond the range of the communication between the reader/writer antenna 42 and the contactless communication antenna.

The conventional portable terminal, therefore, encounters such a problem that a communication performance is worse because of the generation of a space where the conventional portable terminal can not communicate with the reader/writer antenna 42 in spite of being within the distance possible to communicate with the reader/writer antenna 42. The space is hereinafter referred to as "dead band".

It is, therefore, an object of the present invention to provide a portable terminal which can perform good contactless communication with a reader/writer antenna without generating the dead band even at the time of the rear surface communication.

Means for Resolving the Problem

According to one aspect of the present invention, there is provided a portable terminal capable of performing contactless communication with a reader/writer antenna, comprising: a case; an electronic component mounting board provided in the case and having first and second surfaces; a contactless communication antenna provided in the case oppositely to the first surface of the electronic component mounting board and designed to perform the contactless communication with the reader/writer antenna; and a loop coil provided in opposition to the second surface of the electronic component mounting board.

In accordance with the above construction, the change in a resonance frequency of the reader/writer antenna caused by a magnetic coupling between a metal portion included in the portable terminal and the reader/writer antenna is suppressed by a magnetic coupling between the loop coil and the reader/writer antenna. The portable terminal according to the present invention can therefore perform good contactless communication with the reader/writer antenna without generating the dead band even at the time of the rear surface communication.

The case may have an inner surface, and the loop coil may be attached to the inner surface of the case.

The case may have an outer surface, and the loop coil may be attached to the outer surface of the case.

The loop coil may constitute a resonant circuit.

The portable terminal may further comprise a metal portion, in which a resonance frequency of the loop coil is set based on a resonance frequency of the reader/writer antenna changed by a magnetic coupling between the reader/writer antenna and the metal portion. The resonance frequency of the loop coil is preferable to be set within the range from 13.5 MHz to 16 MHz, for example.

The portable terminal may further comprise a magnetic substance attached to the loop coil in opposition to the second surface of the electronic component mounting board.

In accordance with the above construction, the loop coil can be provided in proximity to the electronic component mounting board. The portable terminal according to the present invention is therefore adapted to the thin-shaped portable terminal.

Effects of the Invention

The present invention provides the portable terminal capable of performing good contactless communication with a reader/writer antenna without generating a dead band even at the time of a rear surface communication.

EXPLANATION OF REFERENCE NUMERALS

Figure 1:
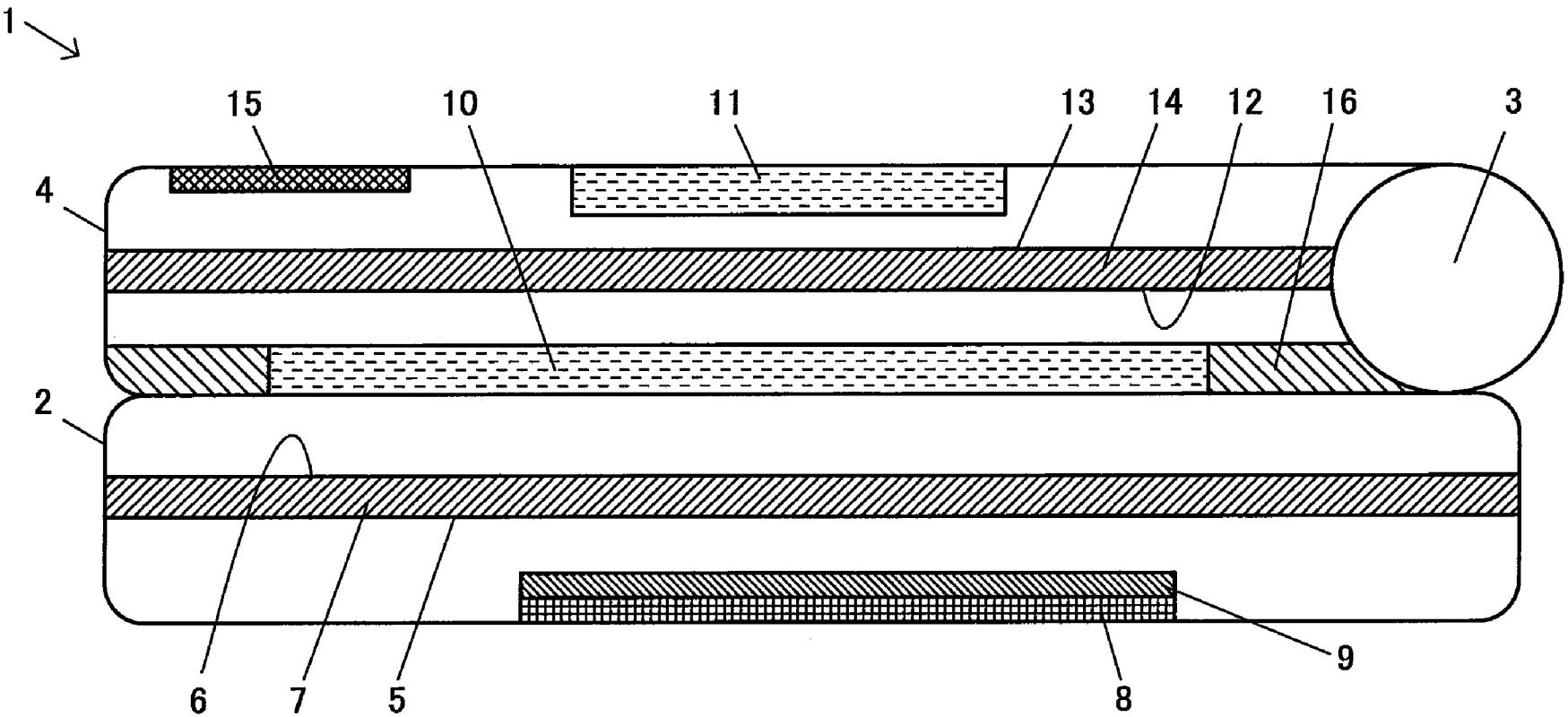
FIG. 1 is a cross-section diagram showing a first preferred embodiment of the portable terminal according to the present invention.

1, 30 portable terminal
2 lower case
3 hinge
4 upper case
7, 14 electronic component mounting board
8 contactless communication antenna
9, 31 magnetic sheet
10 main LCD
11 sub LCD
15 loop coil
20, 42 the reader/writer antenna
41 case
43 flexible substrate
44 soft magnetic radio wave absorbent

DESCRIPTION OF THE PREFERRED EMBODIMENTS

The preferred embodiments of the present invention will be described hereinafter with reference to the drawings.

First Preferred Embodiment

The first preferred embodiment of the portable terminal according to the present invention is shown in FIG. 1.

The portable terminal 1 comprises a lower case 2, an upper case 4 pivotably connected to the lower case 2 by a hinge 3, an electronic component mounting board 7 provided in the lower case 2 and having first and second surfaces 5 and 6, a contactless communication antenna 8 provided in the lower case 2 oppositely to the first surface 5 of the electronic component mounting board 7 and designed to perform contactless communication with a reader/writer antenna, and a magnetic sheet 9 provided on a surface of the contactless communication antenna 8 facing to the electronic component mounting board 7 to cover the contactless communication antenna 8 therewith.

The electronic component mounting board 7 has a circuit formed on at least one of the first and second surface 5 and 6 and designed to perform, for example, communication processing, call processing, and data processing.

The magnetic sheet 9 serves to suppress the generation of an eddy current in metals included in the electronic component mounting board 7 affected by a magnetic field so as to suppress the weakness in the magnetic field affecting the contactless communication antenna 8. The magnetic sheet 9 is made of a magnetic substance having a relative magnetic permeability of 35 in this embodiment.

The portable terminal 1 further comprises a main LCD (Liquid Crystal Display) 10 and a sub LCD 11 provided in the upper case 4 and designed to display characters and images, an electronic component mounting board 14 provided in the upper case 4 and having first and second surfaces 12 and 13, and a loop coil 15 attached to an inner surface of the upper case 4 oppositely to the second surface 13 of the electronic component mounting board 14. The first surface 12 is in opposition to the second surface 6 of the electronic component mounting board 7 under the state the lower case 2 and the upper case 4 are in proximity to each other.

The electronic component mounting board 14 has a circuit formed on at least one of the first and second surface 12 and 13 and designed to perform, for example, display processing to the main LCD 10 and the sub LCD 11.

The loop coil 15 is designed to couple magnetically with metals included in the lower case 2, the upper case 4, the electronic component mounting boards 7 and 14, a battery not shown in the drawings, and the like, such as for example, a metal portion 16 for ensuring the tough upper case 4. The metals are hereinafter collectively referred to as "metal portion included in the portable terminal 1".

Figure 2:
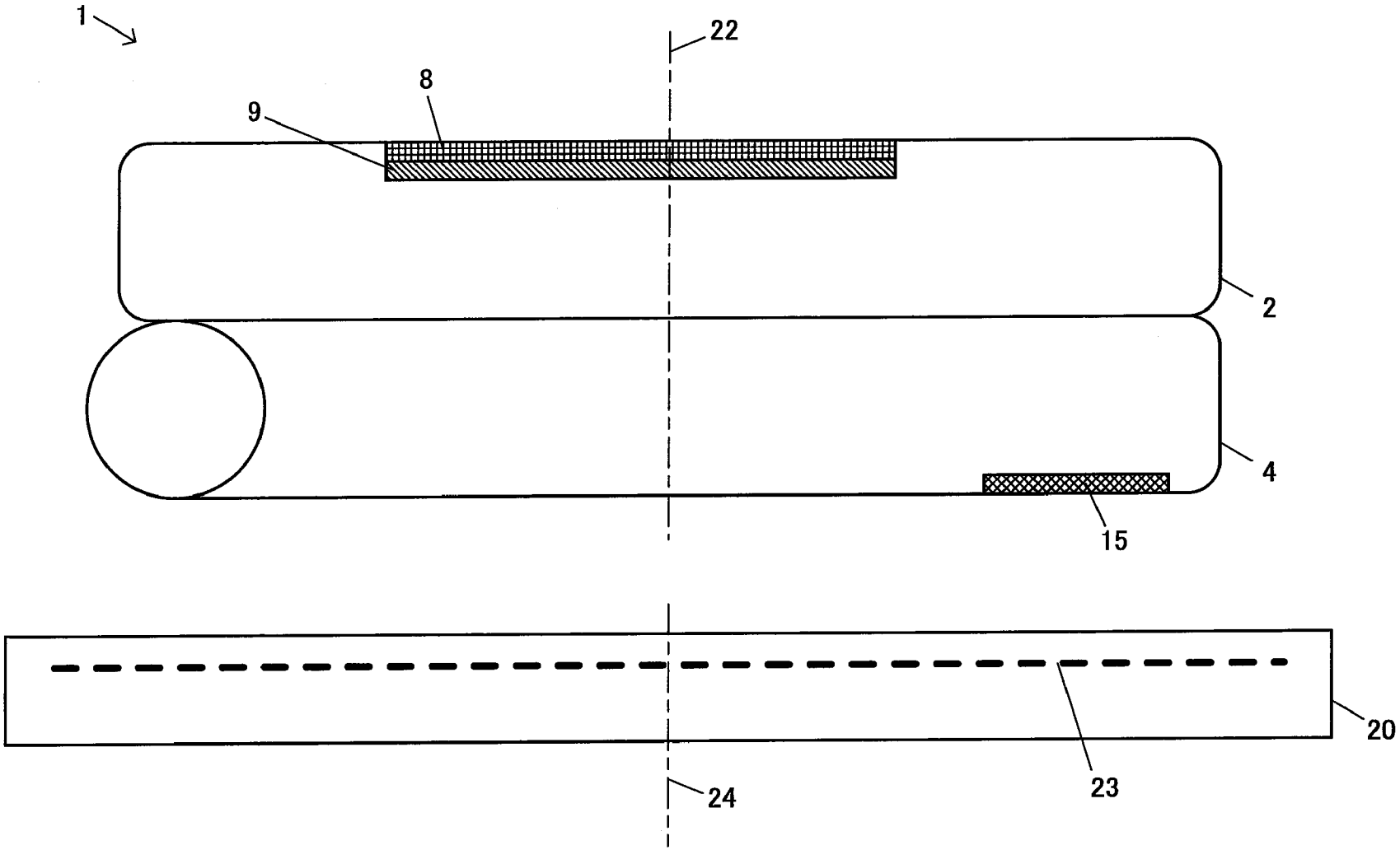
FIG. 2 is a schematic diagram showing one example of positional relationship between the reader/writer antenna and the first preferred embodiment of the portable terminal according to the present invention at the time of the rear surface communication.

The loop coil 15 will be described hereinafter with reference to FIGS. 2 and 3. FIG. 2 is a schematic diagram showing one example of positional relationship between the portable terminal 1 and the reader/writer antenna at the time of the rear surface communication.

Under the condition that the positional relationship between the portable terminal 1 and the reader/writer antenna 20 is as shown in FIG. 2, i.e. the condition that a center axis 22 of the portable terminal 1 and a center axis 24 of a loop pattern 23 are in coaxial relationship with each other, a magnetic coupling coefficient indicative of a degree of magnetic coupling between the loop pattern 23 and the metal portion included in the portable terminal 1 increases to the largest. In the condition, the change amount in a resonance frequency of the reader/writer antenna 20 increases so much as to make the dead band increased to the widest.

Figure 3:
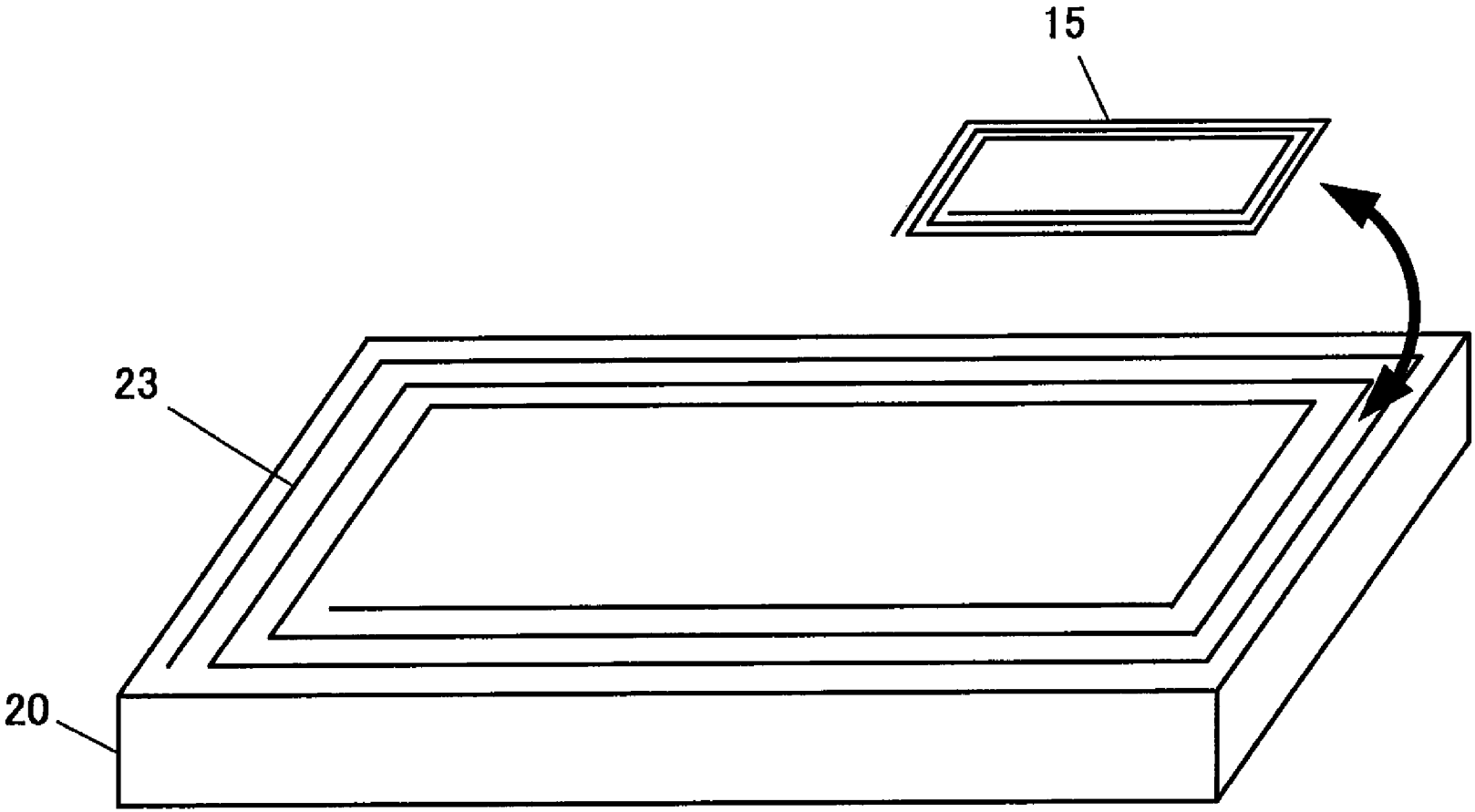
FIG. 3 is a schematic diagram showing a magnetic coupling between the reader/writer antenna and the loop coil constituting the first preferred embodiment of the portable terminal according to the present invention.

As shown in FIG. 3, the loop coil 15 is designed to couple magnetically with the reader/writer antenna 20 under the condition that the positional relationship between the portable terminal 1 and the reader/writer antenna 20 is as shown in FIG. 2.

The loop coil 15 typically constitutes a resonant circuit. The resonance frequency of the loop coil 15 is set based on the resonance frequency of the reader/writer antenna 20 changed by the magnetic coupling between the reader/writer antenna 20 and the metal portion included in the portable terminal 1. The resonance frequency of the reader/writer antenna is set around 13.56 MHz, for example, in a contactless communication system using a carrier frequency of 13.56 MHz. In accordance with the result of our experiment, the resonance frequency of the reader/writer antenna is known to be changed within the range from 13.4 MHz to 15 MHz by the magnetic coupling between the reader/writer antenna and the portable terminal. The resonance frequency of the loop coil 15 is therefore preferable to be set within the range from 13.5 MHz to 16 MHz. The resonance frequency of the loop coil 15 is therefore set at 14.2 MHz in this embodiment.

Figure 4:
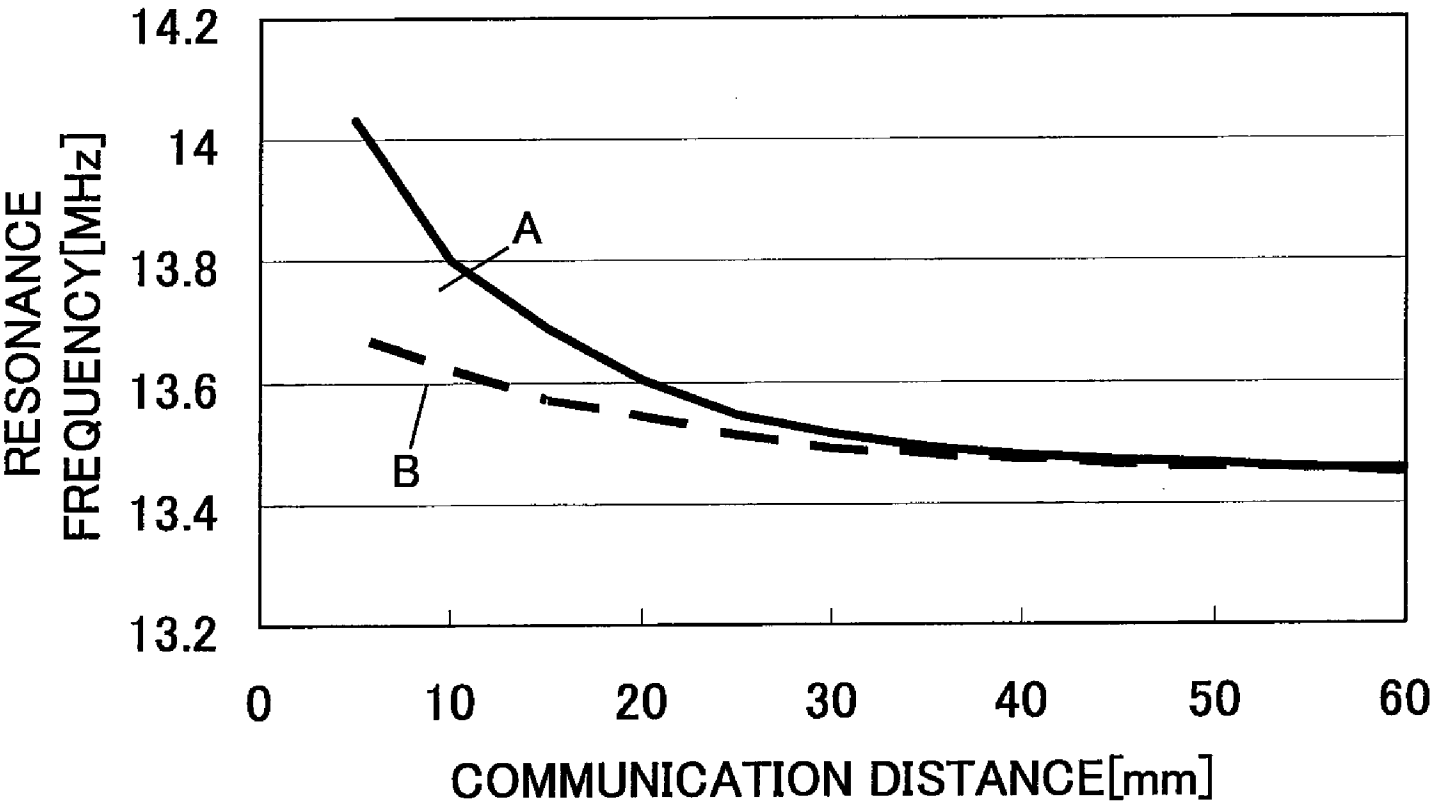
FIG. 4 is a graph showing relations between a resonance frequency of the reader/writer antenna and a communication distance from the first preferred embodiment of the portable terminal according to the present invention to the reader/writer antenna.

FIG. 4 is a graph showing the resonance frequency of the reader/writer antenna 20 measured while the distance between the portable terminal 1 and the reader/writer antenna 20 is changed by the movement of the portable terminal 1 along the center axis 22 of the portable terminal 1 in the positional relationship as shown in FIG. 2 with respect to the reader/writer antenna 20. The distance between the portable terminal 1 and the reader/writer antenna 20 is hereinafter referred to as "communication distance".

The curved line "A" indicates the resonance frequency of the reader/writer antenna 20 where the reader/writer antenna 20 communicates with the conventional portable terminal instead of the portable terminal 1, while the curved line "B" indicates the resonance frequency of the reader/writer antenna 20 where the reader/writer antenna 20 communicates with the portable terminal 1.

FIG. 4 shows the fact that the resonance frequency of the reader/writer antenna 20 sharply increases as either the conventional portable terminal or the portable terminal 1 approaches the reader/writer antenna 20. This results from that fact that, as the communication distance is shorter, the magnetic coupling coefficient between the metal portion included in either the conventional portable terminal or the portable terminal 1 and the reader/writer antenna 20 increases so much as to make the resonance frequency of the reader/writer antenna 20 changed.

The comparison between the curved lines "A" and "B", however, leads to the fact that the increment in the resonance frequency of the reader/writer antenna 20 is suppressed where the reader/writer antenna 20 communicates with the portable terminal 1. This results from the fact that the magnetic coupling coefficient between the metal portion included in the portable terminal 1 and the reader/writer antenna 20 is decreased by the magnetic coupling between the loop coil 15 and the reader/writer antenna 20. As a result, the change in the resonance frequency of the reader/writer antenna 20 caused by the magnetic coupling between the metal portion included in the portable terminal 1 and the reader/writer antenna 20 is suppressed.

Figure 5:
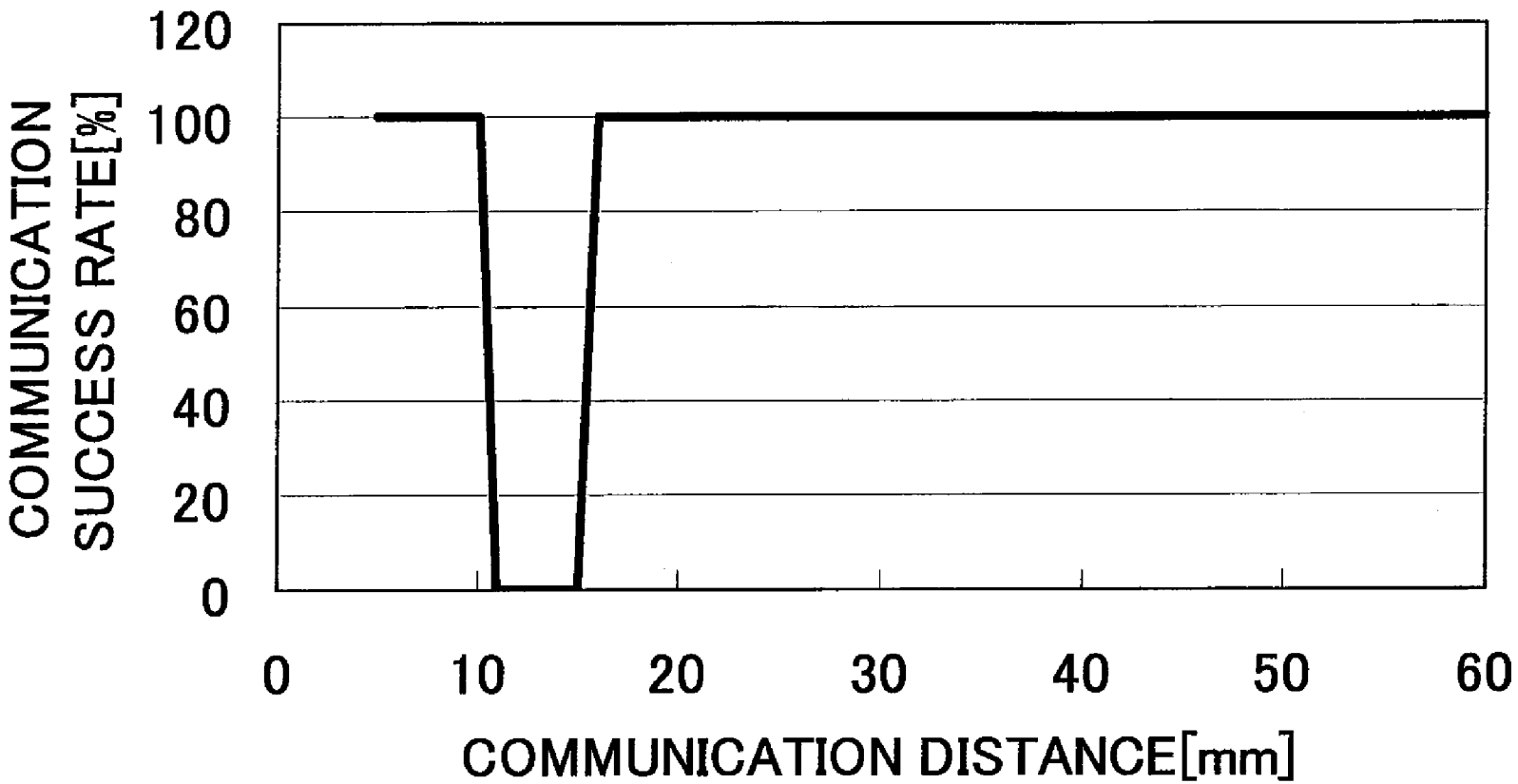
FIG. 5 is a graph showing relations between the communication distance and a communication success rate between the reader/writer antenna and the conventional portable terminal.
Figure 6:
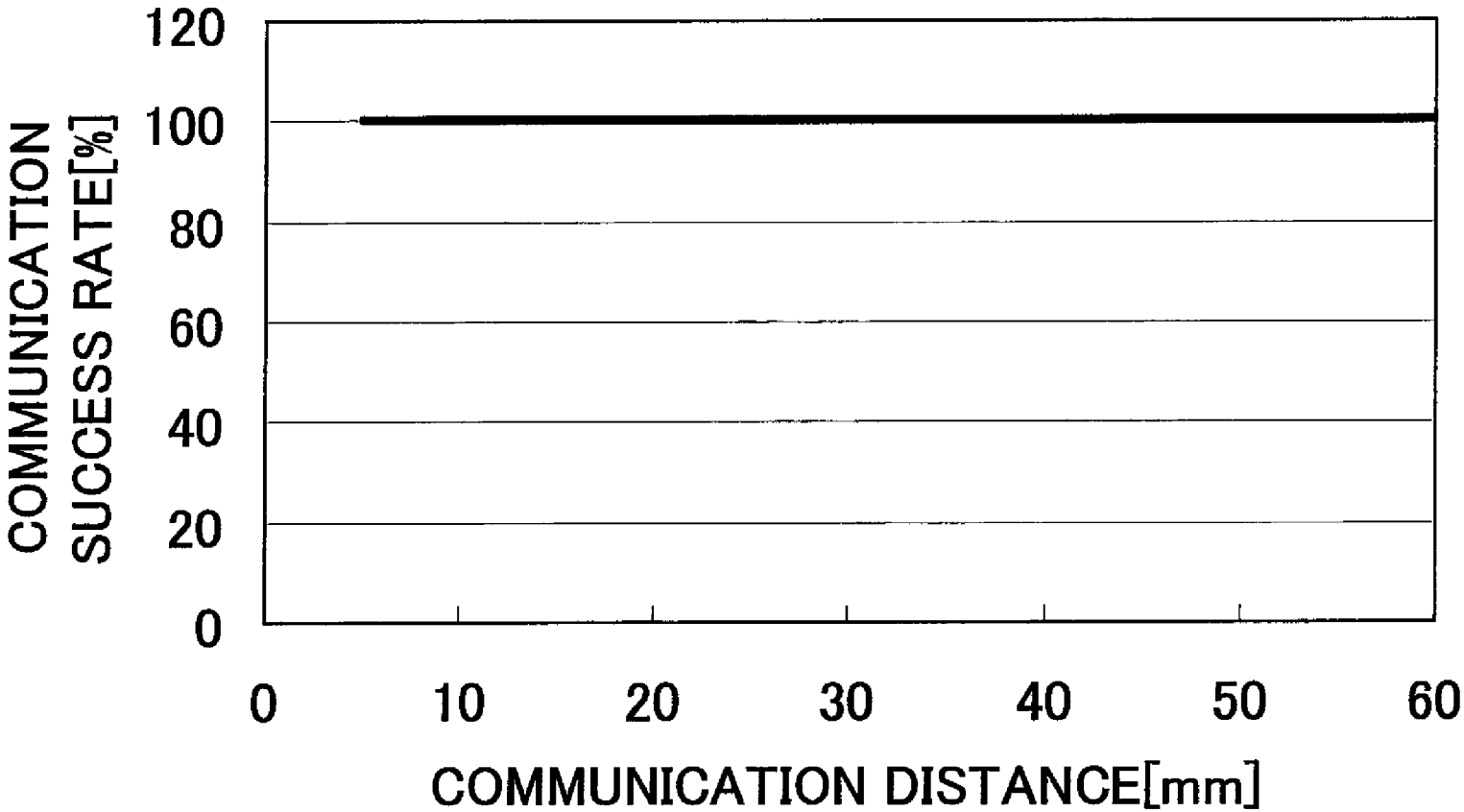
FIG. 6 is a graph showing relations between the communication distance and a communication success rate between the reader/writer antenna and the first preferred embodiment of the portable terminal according to the present invention.

FIG. 5 is a graph showing a communication success rate measured while the distance between the conventional portable terminal and the reader/writer antenna 20 is changed by the movement of the conventional portable terminal along the center axis of the conventional portable terminal in the positional relationship as shown in FIG. 2 with respect to the reader/writer antenna 20. FIG. 6 is a graph showing a communication success rate measured while the distance between the portable terminal 1 and the reader/writer antenna 20 is changed by the movement of the portable terminal 1 along the center axis 22 of the portable terminal 1 in the positional relationship as shown in FIG. 2 with respect to the reader/writer antenna 20.

The term "communication success rate" herein described is intended to indicate a rate of the number of normally completed communications in the number of trials to send and receive data or commands between either the conventional portable terminal or the portable terminal 1 and the reader/writer antenna 20. For example, the communication success rate is 100% where 100 communications are normally completed in 100 trials. The communication success rate is 60% where 60 communications are normally completed in 100 trials. The communication success rate is 0% where no communications is normally completed in 100 trials.

The graph in FIG. 5 shows to the fact that a band where the communication success rate decreases is caused by making the communication distance shorter with the conventional potable terminal. This results from the fact that the resonance frequency of the reader/writer antenna 20 is changed beyond the range of the communication between the reader/writer antenna 20 and the contactless communication antenna.

By making the communication distance even shorter, the communication success rate increases to 100% again, because of the fact that the resonance frequency of the reader/writer antenna 20 increases as shown in FIG. 4 and the magnetic coupling coefficient between the contactless communication antenna and the reader/writer antenna 20 increases.

In contrast, by making the communication distance shorter with the potable terminal 1, no band where the communication success rate decreases is caused as shown in FIG. 6, because of the fact that the increment in the resonance frequency of the reader/writer antenna 20 is suppressed as aforementioned.

As will be seen from the foregoing description, it is to be understood that the change in a resonance frequency of the reader/writer antenna 20 caused by the magnetic coupling between the metal portion included in the portable terminal 1 and the reader/writer antenna 20 is suppressed by the magnetic coupling between the loop coil 15 and the reader/writer antenna 20. The first preferred embodiment of the portable terminal 1 according to the present invention can therefore perform good contactless communication with a reader/writer antenna 20 without generating the dead band even at the time of the rear surface communication.

Figure 7:
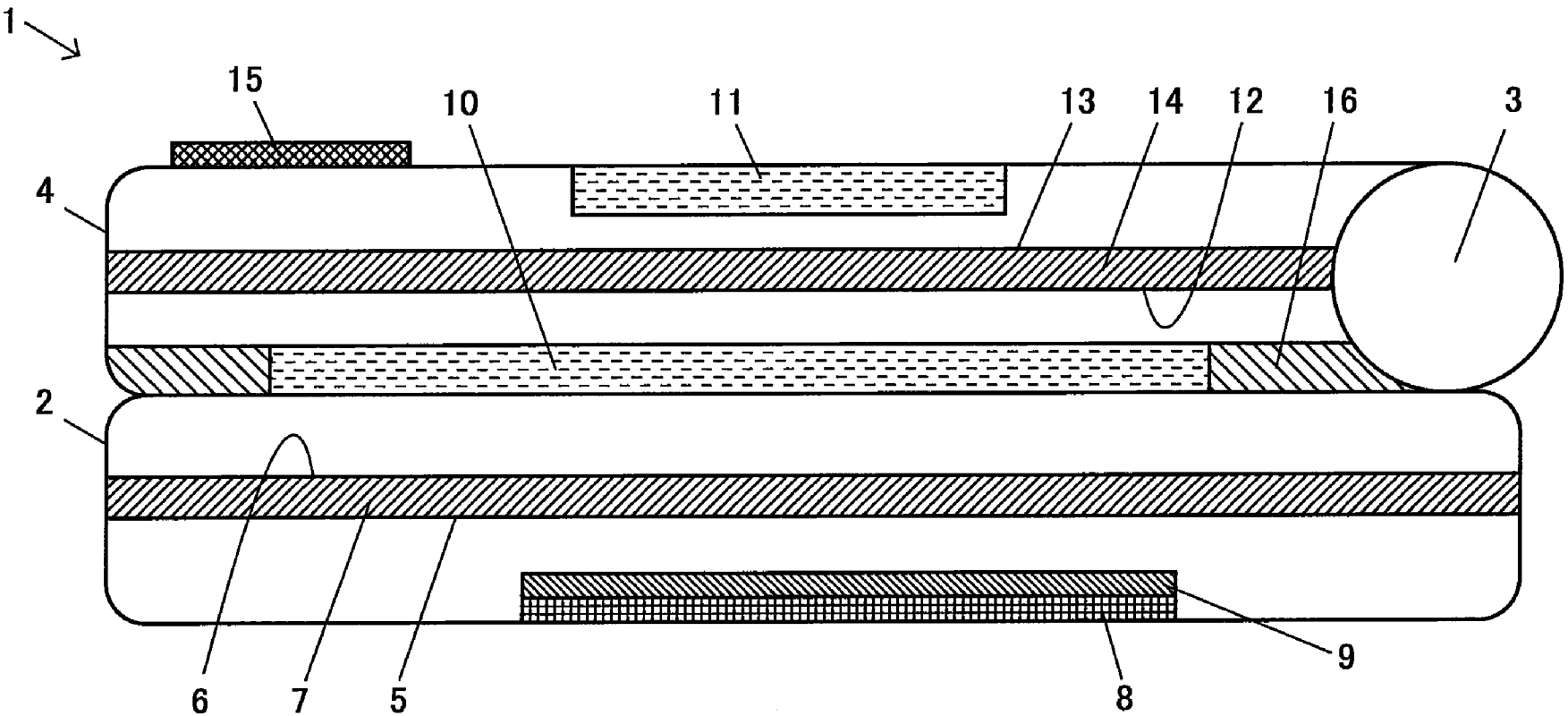
FIG. 7 is a cross-section diagram showing a first variation of the first preferred embodiment of the portable terminal according to the present invention.

While there has been described in the forgoing embodiment about the fact that the loop coil 15 is provided on the inner surface of the upper case 4, the loop coil 15 may be provided the outer surface of the upper case 4 as shown in FIG. 7 in the present invention.

Figure 8:
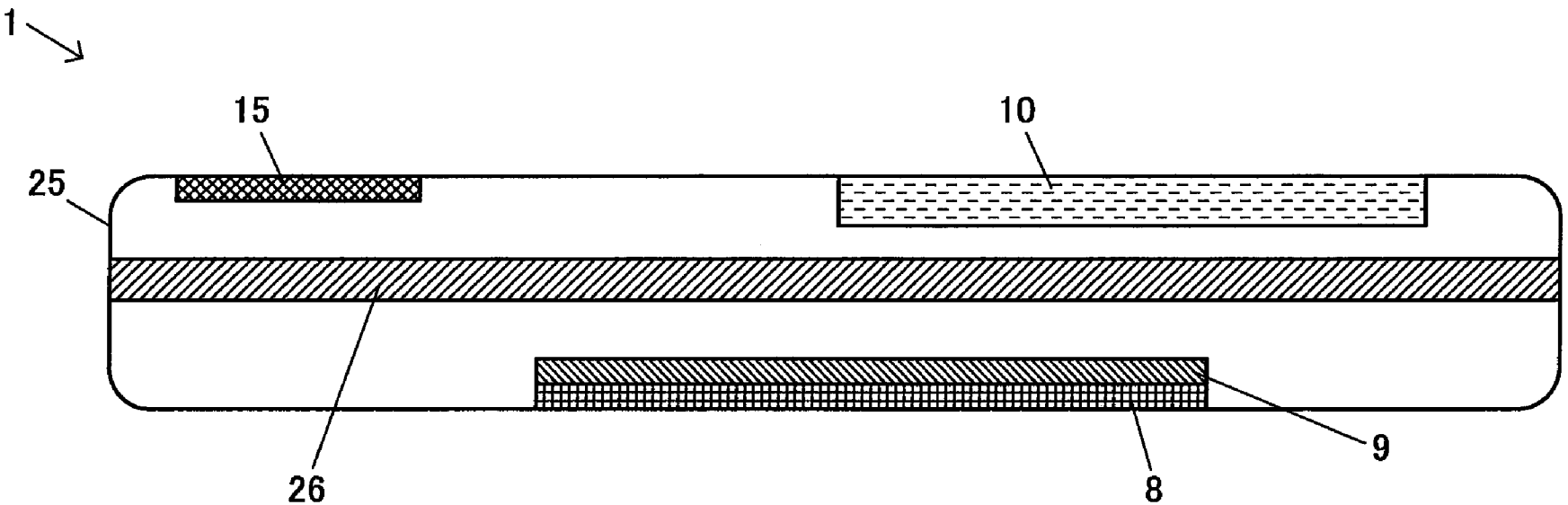
FIG. 8 is a cross-section diagram showing a second variation of the first preferred embodiment of the portable terminal according to the present invention.

Although there has been described in the forgoing embodiment about the fact that the lower case 2 and the upper case 4 are pivotably connected to each other by the hinge 3, the lower case 2 and the upper case 4 may be integrally formed with each other, and the electronic component mounting boards 7 and 14 may be integrally formed with each other as shown in FIG. 8 in the present invention. In FIG. 8, the numerical reference 25 indicates the case forming the lower case 2 and the upper case 4, and the numerical reference 26 indicates the electronic component mounting board forming the electronic component mounting boards 7 and 14.

Second Preferred Embodiment

Figure 9:
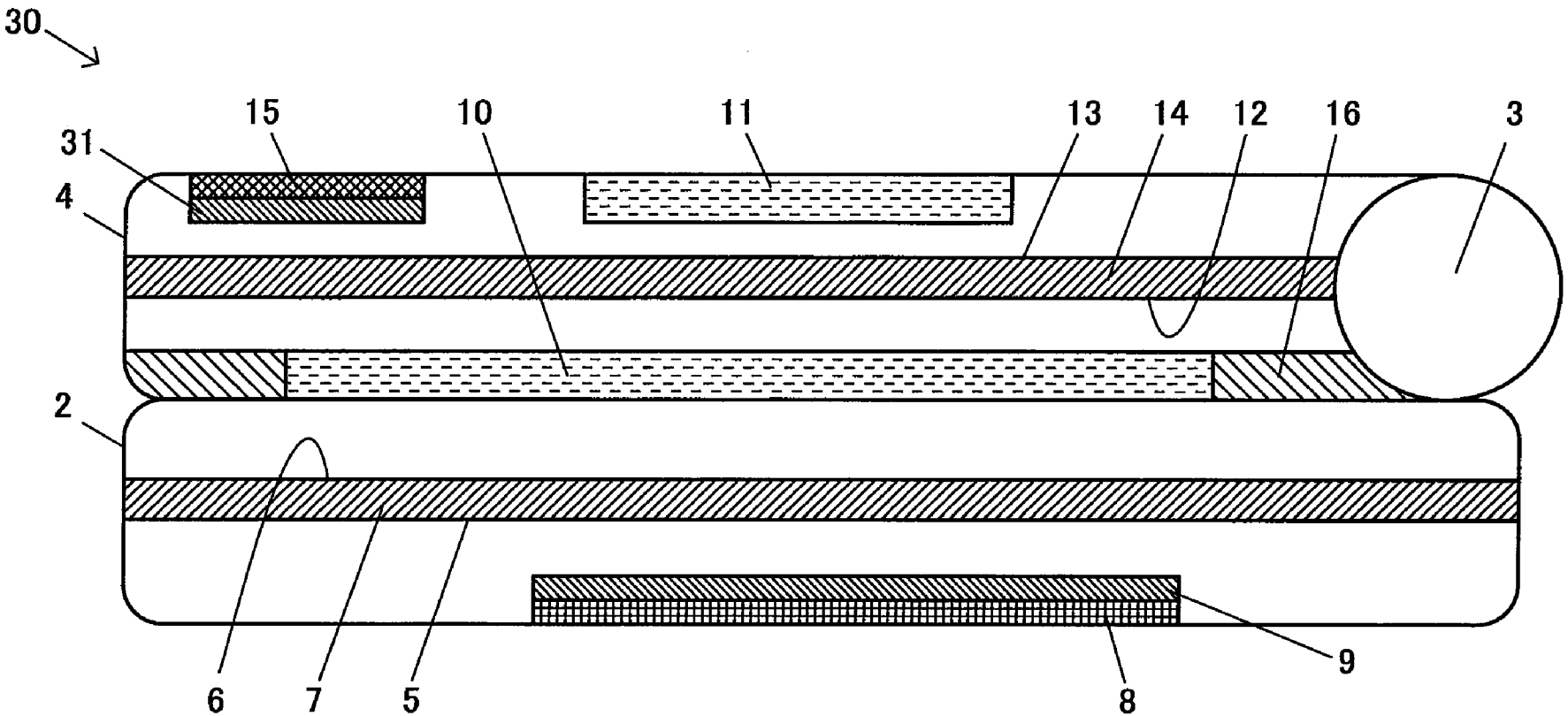
FIG. 9 is a cross-section diagram showing a second preferred embodiment of the portable terminal according to the present invention.
Figure 10:
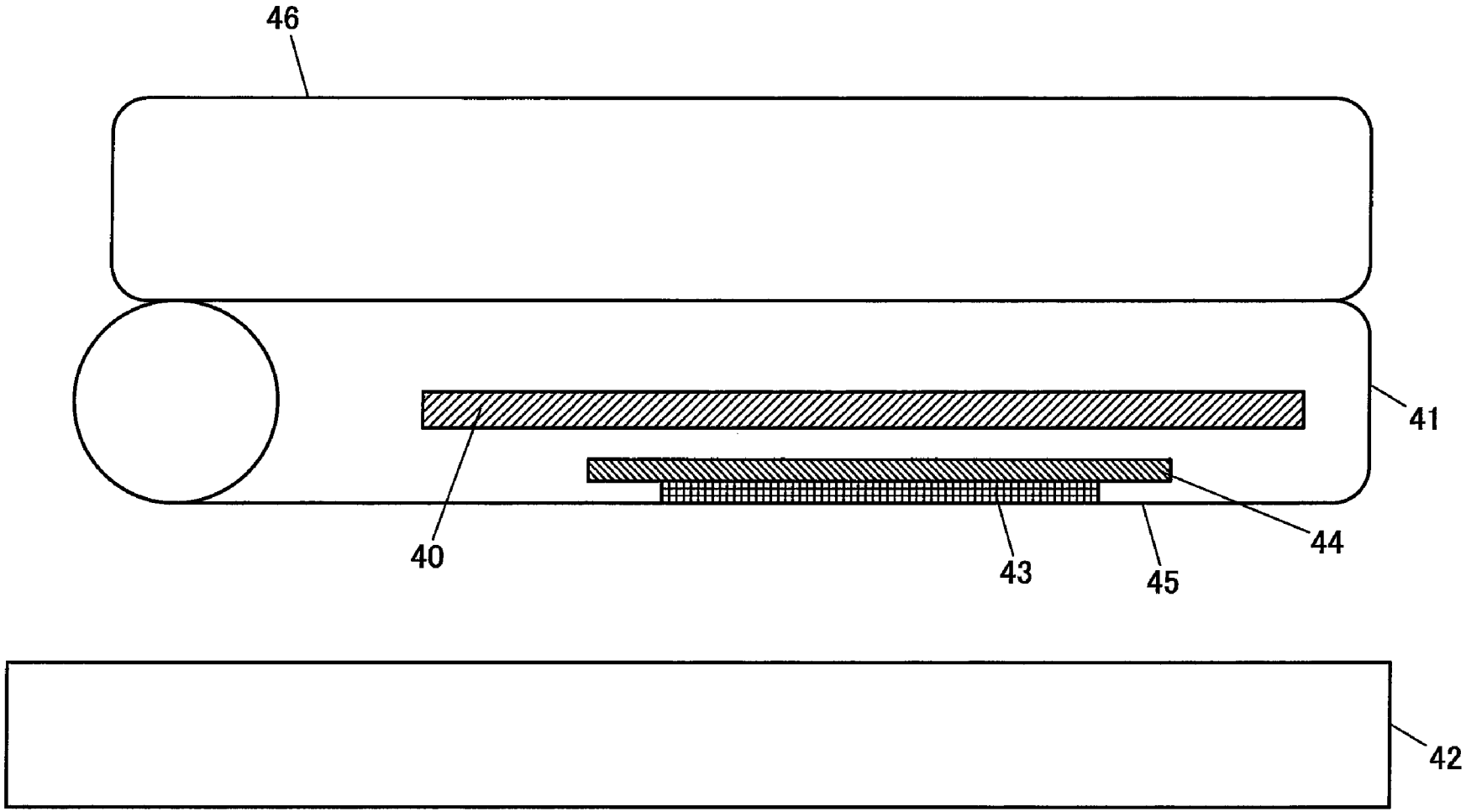
FIG. 10 is a cross-section diagram showing the conventional portable terminal.

The second preferred embodiment of the portable terminal according to the present invention is shown in FIG. 9. The constitutional elements of this embodiment of the portable terminal 30 similar to those of the first preferred embodiment of the portable terminal 1 according to the present invention will be omitted from the following detailed description and identified by the common reference numerals.

The portable terminal 40 comprises a magnetic sheet 31 attached to the loop coil 15 in opposition to the second surface 13 of the electronic component mounting board 14 in addition to the constitutional elements of the first preferred embodiment of the portable terminal 1 according to the present invention.

As will be seen from the foregoing description, it is to be understood that the loop coil 15 can be provided in proximity to the electronic component mounting board 7. The second preferred embodiment of the portable terminal 30 according to the present invention is therefore manufactured to be thin.

INDUSTRIAL APPLICABILITY

As will be seen from the above descriptions, the portable terminal according to the present invention has effects to perform good contactless communication with a reader/writer antenna without generating the dead band even at the time of the rear surface communication. The portable terminal according to the present invention is therefore available to, for example, a portable terminal having a feature of a contactless IC card.

What is claimed is:

1. A portable terminal capable of performing contactless communication with a reader/writer antenna, comprising:

a first case;

a second case;

a first electronic component mounting board provided in said first case and having first and second surfaces;

a second electronic component mounting board provided in said second case and having first and second surfaces, said first surface of said second electronic component mounting board being in opposition to said second surface of said first electronic component mounting board under the state said first case and said second case are in proximity to each other;

a contactless communication antenna provided in said first case oppositely to said first surface of said first electronic component mounting board and designed to perform said contactless communication with said reader/writer antenna; and a loop coil provided on said second case oppositely to said second surface of said second electronic component mounting board.

2. A portable terminal as set forth in claim 1, in which said second case has an inner surface, and said loop coil is attached to said inner surface of said second case.

3. A portable terminal as set forth in claim 1, in which said second case has an outer surface, and said loop coil is attached to said outer surface of said second case.

4. A portable terminal as set forth in claim 1, in which said loop coil constitutes a resonant circuit.

5. A portable terminal as set forth in claim 4, further comprising a metal portion, in which a resonance frequency of said loop coil is set based on a resonance frequency of said reader/writer antenna changed by a magnetic coupling between said reader/writer antenna and said metal portion.

6. A portable terminal as set forth in claim 5, in which said resonance frequency of said loop coil is set within the range from 13.5 MHz to 16 MHz.

7. A portable terminal as set forth in claim 1, further comprising a magnetic substance attached to said loop coil in opposition to said second surface of said electronic component mounting board.

* * * * *